US008720523B2

(12) United States Patent
Nakamura

(10) Patent No.: US 8,720,523 B2
(45) Date of Patent: May 13, 2014

(54) SHIELDING APPARATUS AND CLUTCH USED FOR THE SAME

(75) Inventor: Hajime Nakamura, Tokyo (JP)

(73) Assignee: Tachikawa Corporation, Tokyo (JP)

( * ) Notice: Subject to any disclaimer, the term of this patent is extended or adjusted under 35 U.S.C. 154(b) by 0 days.

(21) Appl. No.: 13/505,338

(22) PCT Filed: Nov. 1, 2010

(86) PCT No.: PCT/JP2010/069444

§ 371 (c)(1),
(2), (4) Date: May 1, 2012

(87) PCT Pub. No.: WO2011/052772

PCT Pub. Date: May 5, 2011

(65) Prior Publication Data

US 2012/0216968 A1 Aug. 30, 2012

(30) Foreign Application Priority Data

Nov. 2, 2009 (JP) ..... 2009-252349
Nov. 2, 2009 (JP) ..... 2009-252350

(51) Int. Cl.
*A47H 5/00* (2006.01)

(52) U.S. Cl.
USPC ..... 160/84.03; 160/115; 160/170; 160/167 R

(58) Field of Classification Search
USPC ..... 160/84.01, 84.03, 84.04, 89, 115, 160/168.1 R, 172 R, 167 R, 70, 71
See application file for complete search history.

(56) References Cited

U.S. PATENT DOCUMENTS 6,834,701 B2 * 12/2004 Colson et al. ..... 160/121.1
7,063,122 B2 * 6/2006 Colson et al. ..... 160/84.03

(Continued)

FOREIGN PATENT DOCUMENTS

JP 2005-207161 A 8/2005
JP 3131044 U 4/2007

(Continued)

OTHER PUBLICATIONS

International Search Report (Japanese and English translation) and Written Opinion (English translation only) dated Jan. 18, 2011 for corresponding International Patent Application No. PCT/JP2010/069444-5 pages.

*Primary Examiner* — Blair M. Johnson
(74) *Attorney, Agent, or Firm* — Maier & Maier, PLLC

(57) ABSTRACT

A shielding apparatus is provided in which operations of raising and lowering a middle rail and operations of raising and lowering a bottom rail can be performed independently from each other by means of a common operation cord. In a shielding apparatus equipped with an elevation apparatus configured to raise and lower a middle rail 3 and a bottom rail 5, whereby a shielding member 2, 4 can be pulled out in the vertical direction or folded in, the elevation apparatus comprises an operation cord 16 of an endless type hanging down from a head box 1, and selective operation means 13 configured to raise or lower the middle rail 3 through an operation of the operation cord 16 in one direction, and to raise or lower the bottom rail 5 through an operation in the other direction, wherein the selective operation means 13 is configured to push up the middle rail 3 by the bottom rail 5 so that the bottom rail 5 and the middle rail 3 can be raised together.

11 Claims, 17 Drawing Sheets

(56) References Cited

U.S. PATENT DOCUMENTS

| | | | | |
|---|---|---|---|---|
| 7,520,311 | B2 * | 4/2009 | Drew | 160/171 |
| 7,571,756 | B2 * | 8/2009 | Smith et al. | 160/121.1 |
| 7,624,784 | B2 * | 12/2009 | Anthony et al. | 160/120 |
| 7,686,059 | B2 * | 3/2010 | Jarosinski et al. | 160/84.03 |
| 8,020,602 | B2 * | 9/2011 | Smith et al. | 160/121.1 |
| 2004/0020608 | A1 * | 2/2004 | Colson et al. | 160/121.1 |
| 2004/0074611 | A1 * | 4/2004 | Colson et al. | 160/84.05 |
| 2007/0144686 | A1 * | 6/2007 | Drew | 160/170 |
| 2008/0053626 | A1 * | 3/2008 | Jarosinski et al. | 160/168.1 P |
| 2008/0149280 | A1 * | 6/2008 | Smith et al. | 160/121.1 |
| 2012/0216968 | A1 * | 8/2012 | Nakamura | 160/340 |
| 2013/0037226 | A1 * | 2/2013 | Nakamura et al. | 160/368.1 |
| 2013/0056162 | A1 * | 3/2013 | Aoki | 160/87 |
| 2013/0056164 | A1 * | 3/2013 | Kawai et al. | 160/321 |

FOREIGN PATENT DOCUMENTS

| | | | |
|---|---|---|---|
| JP | 2008-163578 | A | 7/2008 |
| JP | 2009-002121 | A | 1/2009 |

* cited by examiner (a)

(b)

SHIELDING APPARATUS AND CLUTCH USED FOR THE SAME

RELATED APPLICATIONS

This application is the U.S. national stage application which claims priority under 35 U.S.C. §371 to International Patent Application No.: PCT/JP2010/069444, filed on Nov. 1, 2010, which claims priority under 35 U.S.C. §119, to Japanese Patent Application Nos.: 2009-252349, filed Nov. 2, 2009 and 2009-252350, filed Nov. 2, 2009, the disclosures of which are incorporated by reference herein their entireties.

TECHNICAL FIELD

This invention relates to an elevation apparatus for raising and lowering a screen, slats, a curtain or the like in a pleated screen, a horizontal blind, a roll-up curtain or the like in which a bottom rail and a middle rail can be raised and lowered, respectively, and to a clutch used for the elevation apparatus.

BACKGROUND ART

A pleated screen is an apparatus where a screen configured to be foldable in a zigzag manner in the vertical direction is suspended from a head box, and the screen is raised and lowered by an operation apparatus so as to adjust an amount of lighting arbitrarily.

As a kind of such a pleated screen, one is known which is provided with a bottom rail and a middle rail, and configured such that the middle rail is attached to an bottom end of an upper screen which is suspended from a head box, and the bottom rail is attached to an bottom end of a lower screen which is suspended from the middle rail. The upper screen is made, for example, of a semipermeable texture, such as lace fabric, which allows part of light to permeate, and the lower screen is made of a texture having a light-blocking property.

Further, operation apparatuses are provided for raising and lowering the middle rail and the bottom rail, respectively, so that the middle rail and the bottom rail can be raised and lowered independently from each other by each of the operation apparatuses. With this configuration, when the bottom rail and the middle rail are lowered to their lower limits, a window area can be covered with the semipermeable upper screen, and when the bottom rail is lowered to its lower limit and the middle rail is raised to its upper limit, the window area can be covered with the lower screen having the light-blocking property.

When the bottom rail is lowered to its lower limit and the middle rail is lowered to an intermediary position, it is also possible to cover the top half of the window area with the semipermeable screen and the bottom half of the window area with the light-blocking screen.

PRIOR ART DOCUMENT

Patent Document

Patent Document 1: JP-U-3131044
Patent Document 2: JP-A-2008-163578
Patent Document 3: JP-A-2009-2121
Patent Document 4: JP-A-2005-207161

SUMMARY OF THE INVENTION

Problems to be Solved by the Invention

According to the pleated screen disclosed in Patent Document 1, although a simultaneous raising operation and a simultaneous lowering operation can be performed on both of the middle rail and the bottom rail by an operation using a single operation cord, it is not possible to raise or lower the bottom rail in a state where the middle rail is maintained at the intermediary position. Further, since it is not possible to lower the middle rail and the bottom rail by means of self-weight falling, the lowering operation is cumbersome. Meanwhile, the operation of raising the middle rail requires an operation of reversely winding the elevation cord around a winding pipe, so that the process of the operation cannot be easily understood by a user.

According to the pleated screen disclosed in Patent Document 2, it is necessary to perform a raising operation of the middle rail and the bottom rail and a lowering operation of the middle rail and the bottom rail by separate operation means, so that when the raising operation and the lowering operation are performed successively, the operations are cumbersome. Further, though the lowering operations of the middle rail and the bottom rail can be performed independently from each other, as for the raising operation, it is not possible to perform a raising operation of only the middle rail and a raising operation of only the bottom rail independently from each other. Therefore, the operation for raising or lowering the middle rail and the bottom rail to desired levels is cumbersome.

According to the pleated screen disclosed in Patent Document 3, it is necessary to perform a raising operation of the middle rail and the bottom rail and a lowering operation of the middle rail and the bottom rail by separate operation means. Moreover, since the middle rail must be raised to its upper limit in advance in order to perform the raising operation of the bottom rail, the operation for raising or lowering the bottom rail and the middle rail to desired levels is cumbersome.

According to the pleated screen disclosed in Patent Document 4, it is possible to perform raising and lowering operations of the middle rail and raising and lowering operations of the bottom rail independently from each other by operations using two operation cords. Further, when the middle rail is pushed up by the bottom rail, an elevation cord for suspending the middle rail is wound up so that the elevation cord is prevented from loosening. However, since a starting position of winding of the elevation cord for suspending the middle rail is set by a feed screw axis, a work of assembling the pleated screen such that the timing to start pushing up the middle rail by the bottom rail coincides with the timing to start winding the elevation cord of the middle rail is cumbersome. Moreover, there is a problem that discrepancy arises between the timing to start pushing up the middle rail by the bottom rail and the timing to start winding the elevation cord of the middle rail because of elongation of the elevation cord or the like, whereby the elevation cord for suspending the middle rail loosens.

An object of the present invention is to provide a shielding apparatus in which operations of raising and lowering a middle rail and operations of raising and lowering a bottom rail can be performed independently from each other by means of a common operation cord. Further, another object of the present invention is to provide a shielding apparatus in which operations of raising and lowering a middle rail and operations of raising and lowering a bottom rail can be performed independently from each other, and occurrence of loosening in an elevation cord for the middle rail when the middle rail is pushed up by the bottom rail is certainly prevented. Still another object of the present invention is to provide an intermediate clutch for use in these shielding apparatuses.

Means for Solving the Problems

According to the present invention, a shielding apparatus is provided, which comprises a middle rail suspended from a head box by way of a first elevation cord so as to be capable of being raised and lowered; a bottom rail suspended from the head box by way of a second elevation cord so as to be capable of being raised and lowered; a shielding member suspended at least between the middle rail and the bottom rail; and an elevation apparatus configured to wind up or wind off the second elevation cord within the head box so as to raise or lower the middle rail and the bottom rail, whereby the shielding member can be pulled out in the vertical direction or folded in. The elevation apparatus comprises an operation cord of an endless type hanging down from the head box; and selective operation means configured to be capable of raising or lowering the middle rail through an operation of the operation cord in one direction, and capable of raising or lowering the bottom rail through an operation of the operation cord in the other direction. The selective operation means is configured to push up the middle rail by the bottom rail so that the bottom rail and the middle rail can be raised together.

Further, according to the present invention, an intermediate clutch to be installed in the shielding apparatus is provided. The intermediate clutch comprises a transmission apparatus configured to transmit a rotation of a second driving shaft to a first driving shaft when a load of the middle rail is not applied to the first winding shaft, so that the intermediate clutch can wind up the first elevation cord for suspending the middle rail around a first winding shaft in the head box when the bottom rail and the middle rail are raised together.

Further, according to the present invention, a clutch is provided, which comprises a driving drum configured to rotate integrally with a second driving shaft capable of winding a second elevation cord by way of a second winding shaft, the second elevation cord suspending a bottom rail; a driving gear configured to rotated integrally with the driving drum in accordance with a rotation of the second driving shaft in a raising direction; a cam shaft configured to rotate integrally with a first driving shaft capable of winding a first elevation cord by way of a first winding shaft, the first elevation cord suspending a middle rail; a gear shaft supported so as to be capable of rotating together with the cam shaft and moving in an axial direction of the first driving shaft; a driven gear disposed on an axial line of the first driving shaft and configured to mesh with the driving gear; a cam tube configured to rotate integrally with the first winding shaft and not to be capable of moving in an axial direction of the first winding shaft; and bias means configured to bias the gear shaft toward a rotation transmitting position where a rotation of the driven gear is transmitted to the gear shaft; and an engagement portion provided on the gear shaft and the driven gear and configured to transmit the rotation of the driven gear to the gear shaft when the gear shaft is moved to the rotation transmitting position. This clutch is so configured that the cam shaft is provided with a protrusion, the cam tube is provided with a guide hole so as to engage with the protrusion, the gear shaft is located, when a rotation torque due to a tension of the first elevation cord is applied, such that the rotation of the driven gear is not transmitted to the gear shaft, and the guide hole is so configured as to move the gear shaft to the rotation transmitting position along the first driving shaft when the rotation torque due to the tension of the first elevation cord is not applied to the first winding shaft.

Effects of the Invention

According to the present invention, a shielding apparatus is provided where operations of raising and lowering a middle rail and operations of raising and lowering a bottom rail can be performed independently from each other by means of a common operation cord. Further, according to the present invention, a shielding apparatus is provided where operations of raising and lowering a middle rail and operations of raising and lowering a bottom rail can be performed independently from each other, and occurrence of loosening in an elevation cord for the middle rail when the middle rail is pushed up by the bottom rail is certainly prevented. Still further, according to the present invention, a clutch for use in these shielding apparatuses is provided.

EMBODIMENTS FOR CARRYING OUT THE INVENTION

First Embodiment

Figure 1:
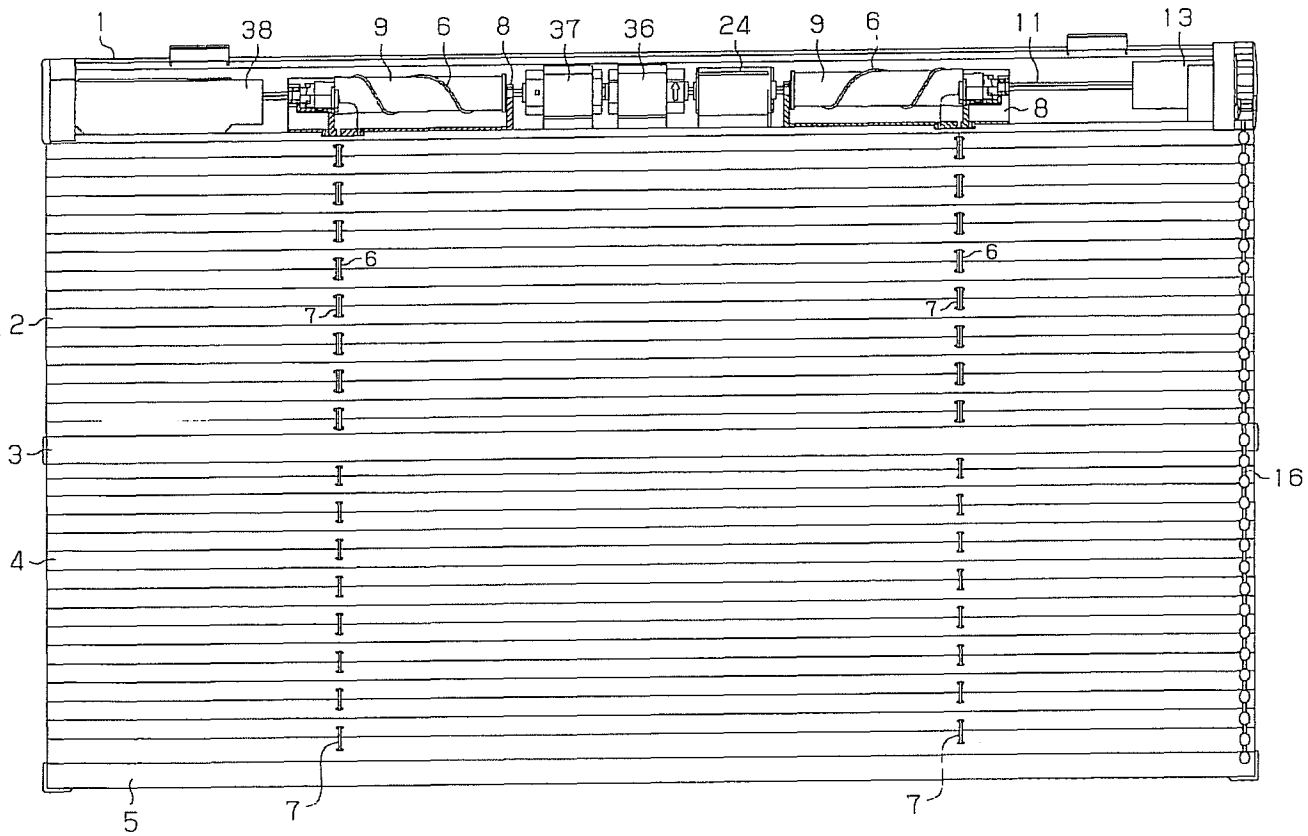
FIG. 1 is a front view illustrating a pleated screen.

Hereafter a first embodiment exemplifying the present invention will be described with reference to the drawings. In a pleated screen shown in FIGS. 1 to 3, an upper screen 2 is suspended from a head box 1, and a middle rail 3 is attached to a bottom end of the upper screen 2. A lower screen 4 is suspended from the middle rail 3, and a bottom rail 5 is attached to a bottom end of the lower screen 4.

The upper screen 2 is made of a semipermeable texture, such as lace fabric, formed to be foldable in a zigzag manner, and the lower screen 4 is made of a texture having a light-blocking property, formed to be foldable in a zigzag manner First elevation cords 6 and second elevation cords 7 are inserted through both sides of the upper screen 2 in a width direction thereof, and bottom ends of the first elevation cords 6 are attached to the middle rail 3. The second elevation cords 7 penetrate the middle rail 3 and are further inserted through the lower screen 4, and bottom ends thereof are attached to the bottom rail 5.

Figure 3:
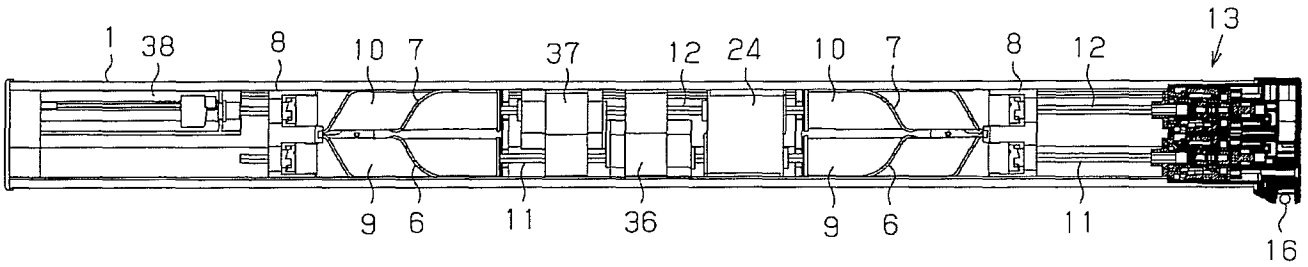
FIG. 3 is plan view illustrating the pleated screen.

Top ends of the first and second elevation cords 6, 7 are wound around the first and second winding shafts 9, 10, respectively, which are held in the head box 1 by the supporting members 8 so as to be capable of rotating. That is, as shown in FIG. 3, the first and second winding shafts 9, 10 are held so as to be capable of rotating within the head box 1 by the supporting members 8 in a state of being at positions above the first and second elevation cords 6, 7 and parallel to each other in a horizontal direction.

Further, the top end of the first elevation cord 6 is wound around the first winding shaft 9, the top end of the second elevation cord 7 is wound around the second winding shaft 10, and the first and second elevation cords 6, 7 are wound in opposite directions to each other with respect to the first and second winding shafts 9, 10. Moreover, the first and second elevation cords 6, 7 are so configured as to be wound up or wound off in a helical manner based on rotations of the first and second winding shafts 9, 10.

A first driving shaft 11 of a shape of a hexagonal rod is inserted through the first winding shaft 9 such that their relative rotation is not possible, and a second driving shaft 12 similarly of a shape of a hexagonal rod is inserted through the second winding shaft 10 such that their relative rotation is not possible. They are so configured that when the first driving shaft 11 is rotated in a winding-up direction of the first elevation cord 6, the first elevation cord 6 is wound up around the first winding shaft 9, and when the second driving shaft 12 is rotated in a winding-up direction of the second elevation cord 7, the second elevation cord 7 is wound up around the second winding shaft 10.

Figure 4:
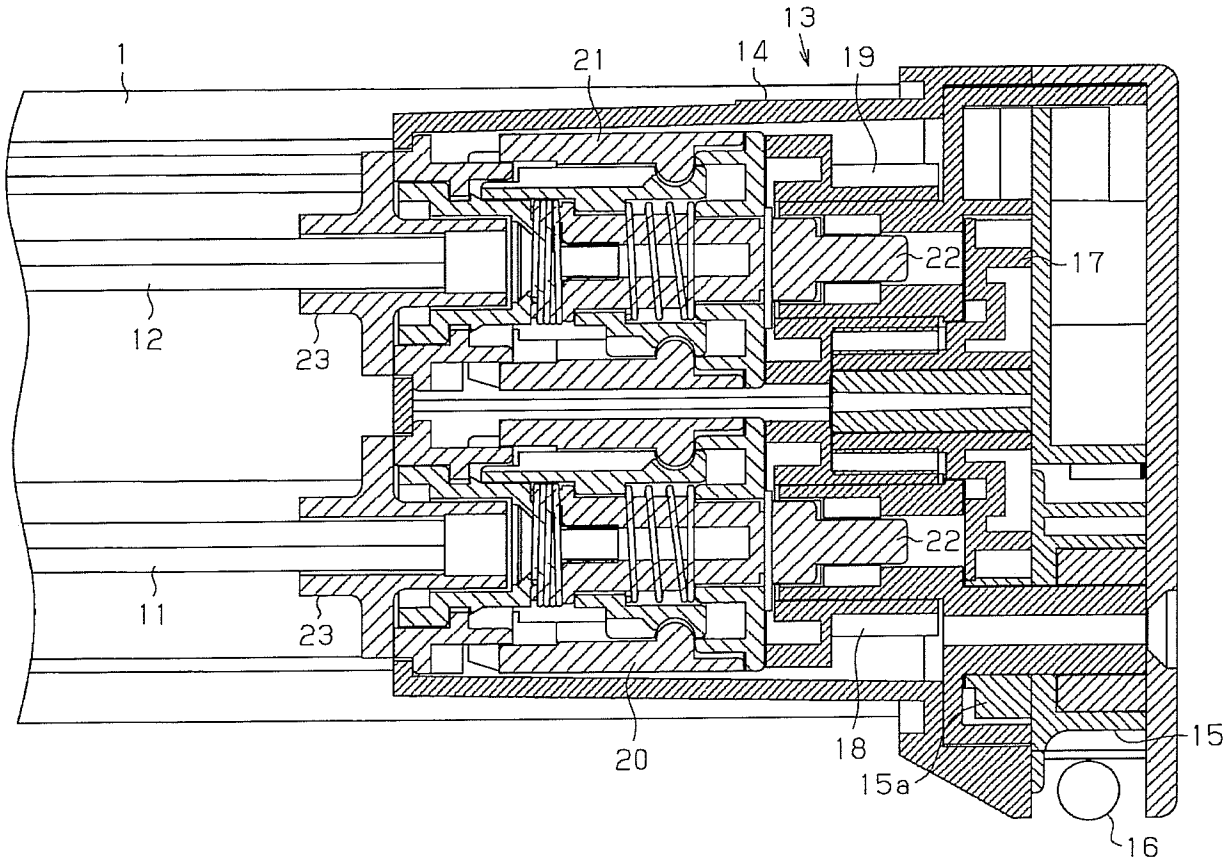
FIG. 4 is a sectional view illustrating an operation apparatus.

To one end of the head box 1 is attached an operation apparatus 13 for rotationally driving the first and second driving shafts 11, 12. As shown in FIG. 4, a pulley 15 is supported so as to be rotatable on a base end side in a case 14 of the operation apparatus 13, and a ball chain 16 of an endless type is engaged with the pulley 15 so as to hang down therefrom. They are so configured that the pulley 15 can be rotated by an operation of the ball chain 16.

A gear 15*a* is formed integrally with the pulley 15, and a transmission gear 17 supported so as to be rotatable by the case 14 meshes with the gear 15*a*. Therefore, when the pulley 15 is rotated, the transmission gear 17 is rotated.

With the transmission gear 17 mesh a pair of first and second clutch gears 18, 19 supported so as to be rotatable by the case 14 on both sides in a diametrical direction of the transmission gear 17. When the transmission gear 17 is rotated, the first and second clutch gears 18, 19 are rotated in a same direction.

First and second transmission clutches 20, 21 of a same configuration are housed in a front end side of the case 14, and input shafts 22 of the first and second transmission clutches 20, 21 are fitted with centers of the first and second clutch gears 18, 19. Therefore, when the first and second clutch gears 18, 19 are rotated, the input shafts 22 of the first and second transmission clutches 20, 21 are rotated in a same direction.

The first and second transmission clutches 20, 21 are equipped with a known function of transmitting only rotations of the input shafts 22 in one direction to output shafts 23, respectively, and the directions for which the rotations are transmitted are opposite to each other. An end of the first driving shaft 11 is fitted with an output shaft 23 of the first transmission clutch 20, and an end of the second driving shaft 12 is fitted with an output shaft 23 of the second transmission clutch 21.

Figure 2:
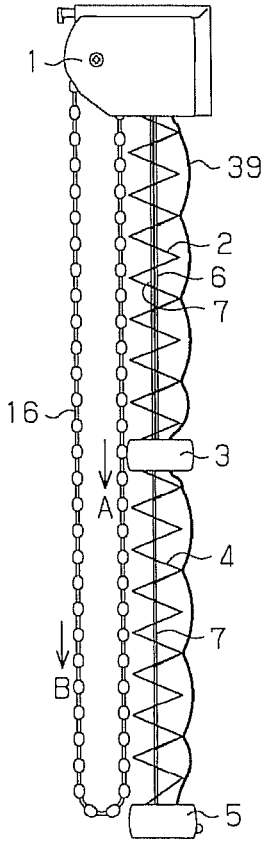
FIG. 2 is a side view illustrating the pleated screen.

With this configuration, when the ball chain 16 is operated, for example, in the direction of arrow A shown in FIG. 2, only the second driving shaft 12 is rotated so that the second winding shaft 10 is rotated in a winding-up direction of the second elevation cord 7.

Further, when the ball chain 16 is rotated in the direction of arrow B shown in FIG. 2, only a first driving shaft 11 is rotated so that the first winding shaft 9 is rotated in a winding-up direction of the first elevation cord 6.

The first and second driving shafts 11, 12 are inserted through a stopper apparatus 24 in a middle portion of the head box 1. The stopper apparatus 24 performs a known function of preventing self-weight falling of the middle rail 3 and the bottom rail 5 when the ball chain 16 is released from a user's hand after an operation of raising the middle rail 3 or bottom rail 5.

Figure 5:
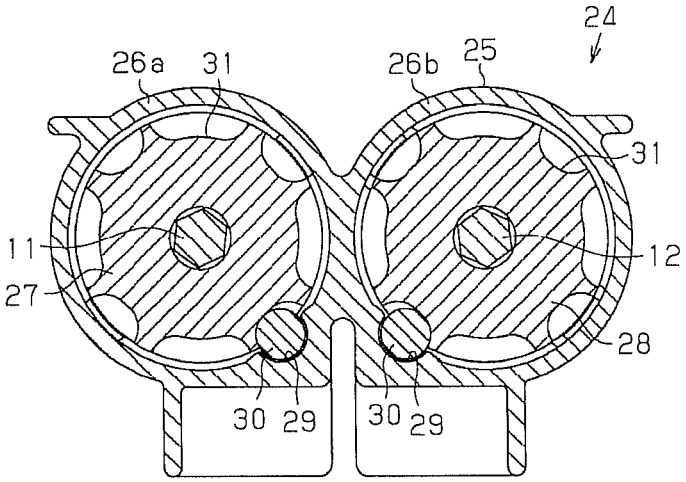
FIG. 5 is a sectional view illustrating a stopper apparatus.

Describing the specific configuration of the stopper apparatus 24, a case 25 of the stopper apparatus 24 is secured to the head box 1, and comprises two cylindrical portions 26*a*, 26*b*, as shown in FIG. 5. A first drum 27 and a second drum 28 are held so as to be rotatable in the cylindrical portions 26*a*, 26*b*. Note that the first and second drums 27, 28 can be inserted into the cylindrical portions 26*a*, 26*b* in opposite directions to each other.

The first driving shaft 11 is inserted through the first drum 27 such that their relative rotation is not possible, and the second driving shaft 12 is inserted through the second drum 28 such that their relative rotation is not possible. Thus, the first drum 27 is configured to rotate integrally with the first driving shaft 11, and the second drum 28 is configured to rotate integrally with the second driving shaft 12.

On inner peripheral surfaces of the cylindrical portions 26*a*, 26*b* are formed slide grooves 29, respectively, having semicircular cross-sections and extending along axial directions of the first and second driving shaft 11, 12, and clutch balls 30 formed of steel balls are held in the slide grooves 29 so as to be movable along the slide grooves 29.

On outer peripheral surfaces of the first and second drums 27, 28 are formed guide grooves 31, having semicircular cross-sections, for guiding the clutch balls 30. When the first and second drums 27, 28 are rotated, the clutch balls 30 rotate around along the guide grooves 31 while traveling along the slide grooves 29.

The guide grooves 31 of the first and second drums 27, 28 are of a same configuration, and the difference in rotation direction of the first and second drums 27, 28 is dealt with by attaching them to the case 25 reversely in a left-right direction. With respect to the first drum 27, a configuration of the guide groove 31 is described with reference to a development state shown in FIG. 6.

Figure 6:
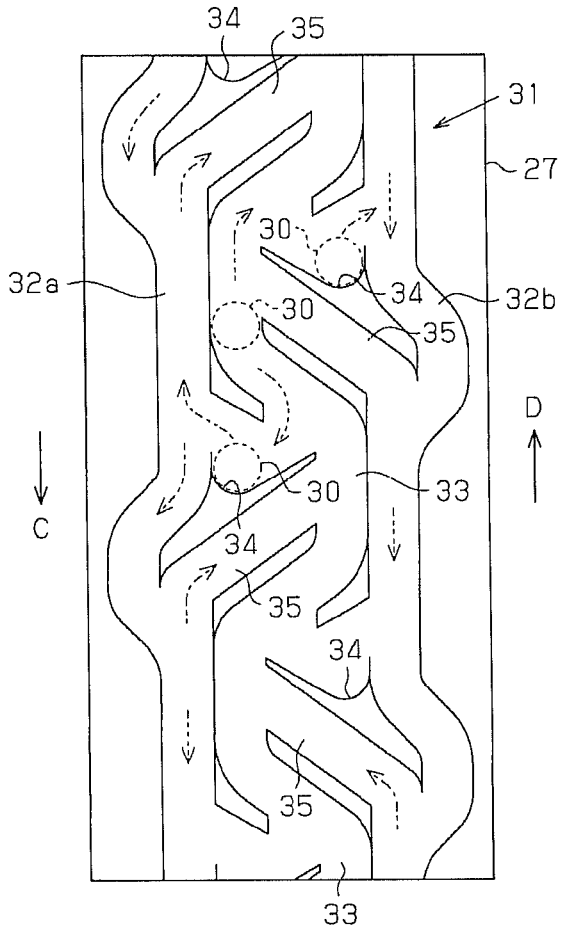
FIG. 6 is a development view illustrating a guide groove of a drum.

In FIG. 6, when the first drum 27 is rotated in a direction for lowering the middle rail 3, the clutch ball 30 moves relatively in the direction of arrow C along the guide groove 31. Further, when the first drum 27 is rotated in a direction for raising the middle rail 3, the clutch ball 30 moves relatively in the direction of arrow D along the guide groove 31.

Lowering grooves 32*a*, 32*b* are formed in both end portions of a peripheral surface of the first drum 27, and a raising groove 33 is formed in a middle portion. Locking portions 34 are formed so as to communicate with the raising groove 33, which hinders movement of the clutch ball 30 after a slight rotation, when the first drum 27 is rotated in the direction for lowering the middle rail 3 in a state where the clutch ball 30 is situated within the raising groove 33. The locking portions 34 are formed at four positions at regular intervals in a peripheral direction.

When the first drum 27 is rotated in the direction for raising the middle rail 3 from a state where the clutch ball 30 is engaged with the locking portion 34, the clutch ball 30 is guided by either of the lowering grooves 32*a*, 32*b*.

In the lowering grooves 32*a*, 32*b*, return grooves 35 are formed at four positions at regular intervals in the peripheral direction, which guide the clutch ball 30 to the raising groove 33, when the first drum 27 is rotated in the direction for raising the middle rail 3 from a state where the clutch ball 30 is situated within either of the lowering grooves 32*a*, 32*b*.

Describing an operation of the stopper apparatus 24 provided with the first drum 27 thus configured, when the first driving shaft 11 is rotated by operating the ball chain 16 in a direction for winding-up the first elevation cord 6 so that the middle rail 3 is raised, the clutch ball 30 is moving relatively within the raising groove 33 in the direction of arrow D.

When the ball chain 16 is released from the user's hand after the middle rail 3 is raised to a desired level, the clutch ball 30 moves within the raising groove 33 in the direction of arrow C due to a weight of the middle rail 3, and engages with the locking portion 34. Then, the movement of the clutch ball 30 in the direction of arrow C is hindered, so that the rotation of the first drum 27 is hindered, whereby self-weight falling of the middle rail 3 is hindered.

From this state, when the middle rail 3 is raised a little by operating the ball chain 16, the clutch ball 30 moves from the locking portion 34 to either of the lowering grooves 32*a*, 32*b*. When the ball chain 16 is released from the user's hand in this state, the clutch ball 30 enters into a state of rotating around in either the lowering grooves 32*a*, 32*b* in the direction of arrow C, whereby the middle rail 3 is lowered.

Further, when the ball chain 16 is operated in the direction for raising the middle rail 3 after the middle rail 3 has lowered to its lower limit or while the middle rail 3 is being lowered, the clutch ball 30 moves into the raising groove 33 from either of the lowering grooves 32*a*, 32*b* by way of the return groove 35. Then, the clutch ball 30 rotates around in the raising groove 33 in the direction of arrow D, whereby the middle rail 3 is raised.

The stopper apparatus 24 is equipped with a function affecting on the operation of raising and lowering the bottom rail 5 due to an operation of the second drum 28, which is similar to the function on the operation of raising and lowering the middle rail 3.

As shown in FIGS. 1 and 3, the first and second driving shafts 11, 12 are inserted through governor apparatuses 36, 37, respectively, on a side of the stopper apparatus 24. The governor apparatuses 36, 37 suppress rotation speeds of the first and second driving shafts 11, 12, respectively, to equal to or lower than a predetermined value, and thus, suppress lowering speeds of the middle rail 3 and the bottom rail 5 during self-weight falling.

At the other end of the head box 1, a lower limit apparatus 38 is disposed for setting the lower limit position of the bottom rail 5, through setting a maximum wound-off amount of the second elevation cord 7 from the second winding shaft 10.

As shown in FIG. 2, a pitch retention cord 39 is disposed on a back side of the upper screen 2 and the lower screen 4 at insertion positions of the first and second elevation cords 6, 7. The pitch retention cord 39 operates such that a pitch of folding lines of the upper screen 2 and the lower screen 4 is constant.

Next, an operation of the pleated screen configured as shown above will be described. When the ball chain 16 is lowered in the direction of arrow A, only the second driving shaft 12 is rotated so that the second elevation cord 7 is wound up around the second winding shaft 10, and thus, the bottom rail 5 is raised. When the ball chain 16 is released from the user's hand after the bottom rail 5 is raised to a desired level, the bottom rail 5 is maintained at the desired level due to an operation of preventing self-weight falling of the stopper apparatus 24.

When the ball chain 16 is pulled in the direction of arrow A, in this state, and then released from the user's hand, the operation of preventing self-weight falling of the stopper apparatus 24 is canceled so that the bottom rail 5 self-weight falls.

When the ball chain 16 is pulled down in the direction of arrow B, only the first driving shaft 11 is rotated so that the first elevation cord 6 is wound up around the winding shaft 9, and the middle rail 3 is raised. Then, when the ball chain 16 is released from the user's hand after the middle rail 3 is raised to a desired level, the middle rail 3 is maintained at the desired level due to an operation of preventing self-weight falling of the stopper apparatus 24.

When the ball chain 16 is pulled in the direction of arrow B, in this state, and subsequently released from the user's hand, the operation of preventing self-weight falling of the stopper apparatus 24 is canceled so that self-weight falling of the middle rail 3 is allowed.

Figure 7:
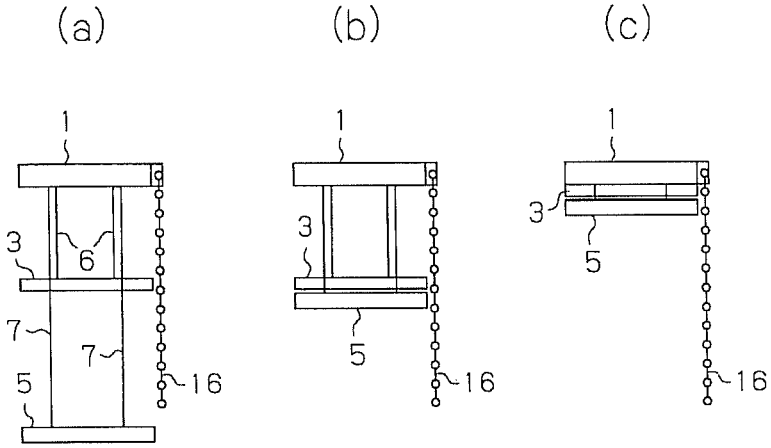
FIG. 7(*a*) to (*c*) are explanatory views illustrating raising and lowering operations of a screen.

When the bottom rail 5 is raised from a state where the middle rail 3 is maintained at a middle in an elevation range, and the bottom rail 5 is located near the lower limit, as shown in FIG. 7(*a*), the bottom rail 5 reaches the middle so that a state is attained where the bottom rail 5 pushes up the middle rail 3, as shown in FIG. 7(*b*).

When the bottom rail 5 is raised further, the middle rail 3 is pushed up by the bottom rail 5 together, and when the ball chain 16 is released from the user's hand in a state where the bottom rail 5 and the middle rail 3 are raised to an upper limit, as shown in FIG. 7(*c*), the bottom rail 5 and the middle rail 3 are maintained immediately below the head box 1.

When the ball chain 16 is pulled in the direction of arrow A, in this state, and subsequently released from the user's hand, since the operation of preventing self-weight falling of the stopper apparatus 24 on the bottom rail 5 is canceled, the bottom rail 5 self-weight falls.

At this time, the middle rail 3 self-weight falls together with the bottom rail 5, but after the middle rail 3 has fallen to the level shown in FIG. 7(*b*), the operation of preventing self-weight falling of the stopper apparatus 24 on the middle rail 3 is activated, so that the middle rail 3 is maintained at this level. Subsequently, when the ball chain 16 is pulled a little in the direction of arrow B and the released from the user's hand, the operation of preventing self-weight falling of the stopper apparatus 24 on the middle rail 3 is canceled, so that the middle rail 3 self-weight falls.

According to the pleated screen configured as described above, the following effects are obtained.

(1) Operating the common ball chain 16 makes it possible to perform operations of raising and lowering the middle rail 3 and the bottom rail 5 independently from each other.

(2) Lowering operations of the middle rail 3 and the bottom rail 5 can be easily performed due to their independent self-weight falling.

(3) When the raising operation of the bottom rail 5 is performed, the middle rail 3 can be raised while being pushed up by the bottom rail 5. Therefore, the middle rail 3 can be raised together by raising the bottom rail 5.

(4) The bottom rail 5 and the middle rail 3 having been raised together can be maintained at a desired level by means of the operation of the stopper apparatus 24.

(5) When the bottom rail 5 is allowed to self-weight fall after the bottom rail 5 and the middle rail 3 are raised together, the bottom rail 5 and the middle rail 3 can be lowered together. Further, the self-weight falling operation of the middle rail 3 can be automatically stopped, by the operation of the stopper apparatus 24, at the starting position of pushing up by the bottom rail 5.

Second Embodiment

FIGS. 8 to 13 show a second embodiment. This embodiment comprises an intermediate clutch 41 which is configured to wind up, around the first winding shaft 9, the first elevation cord 6 suspending the middle rail 3 so as to prevent the first elevation cord 6 from loosening in the head box 1 or between the folding lines of the upper screen 2, when the middle rail 3 is pushed up by the bottom rail 5. Other configurations than the intermediate clutch 41 are the same as those of the first embodiment, and thus, the components same as those of the first embodiment are denoted by the same reference symbols, and detailed descriptions thereof are omitted.

Figure 8:
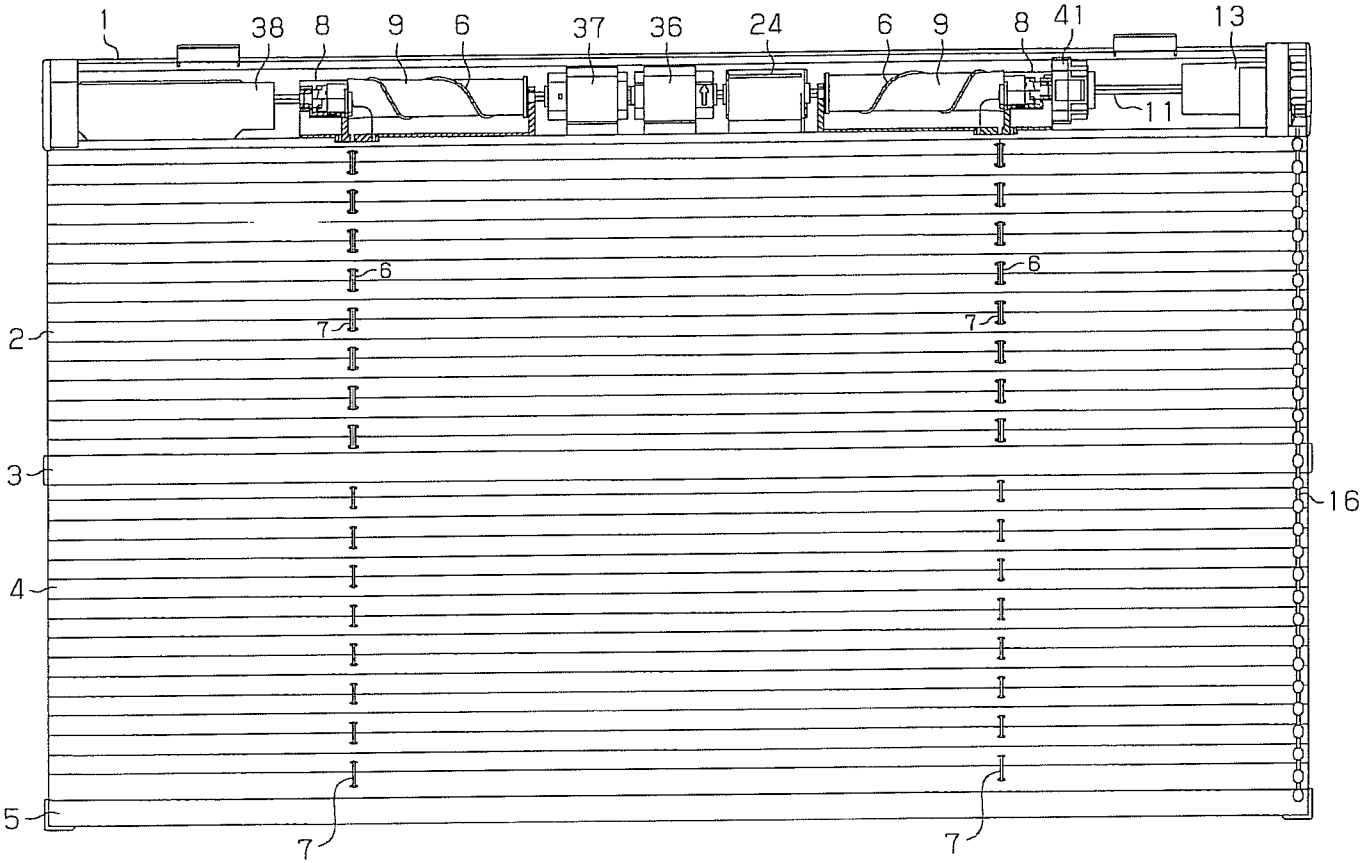
FIG. 8 is a front view illustrating a pleated screen of a second embodiment.
Figure 9:
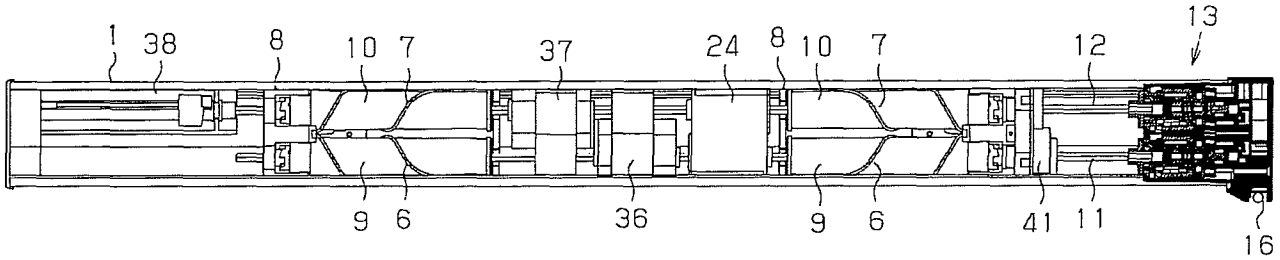
FIG. 9 is a plan view illustrating the pleated screen of the second embodiment.
Figure 10:
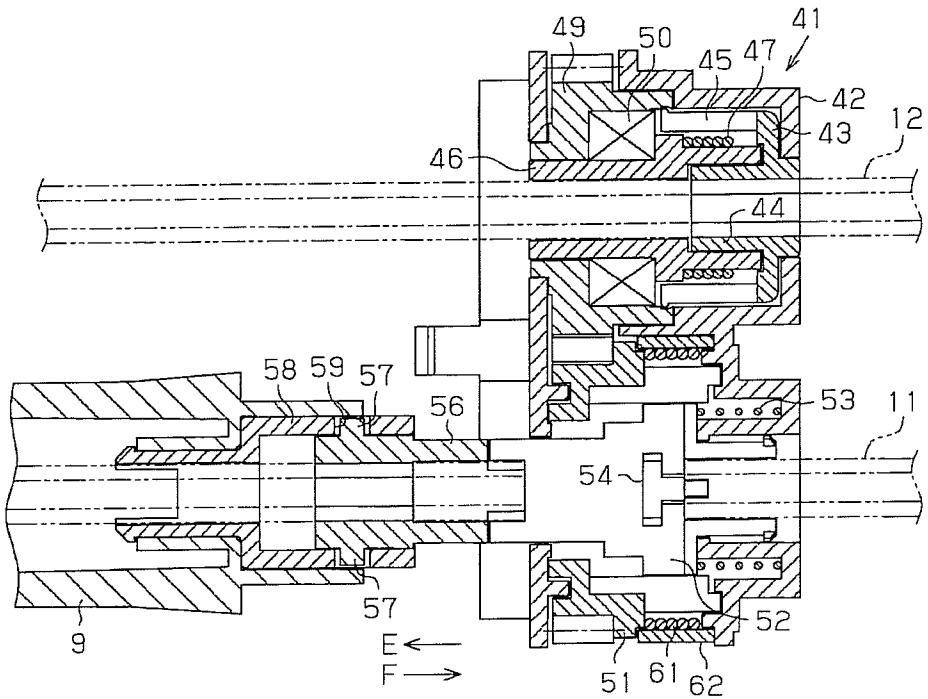
FIG. 10 is a sectional view illustrating an intermediate clutch.
Figure 11:
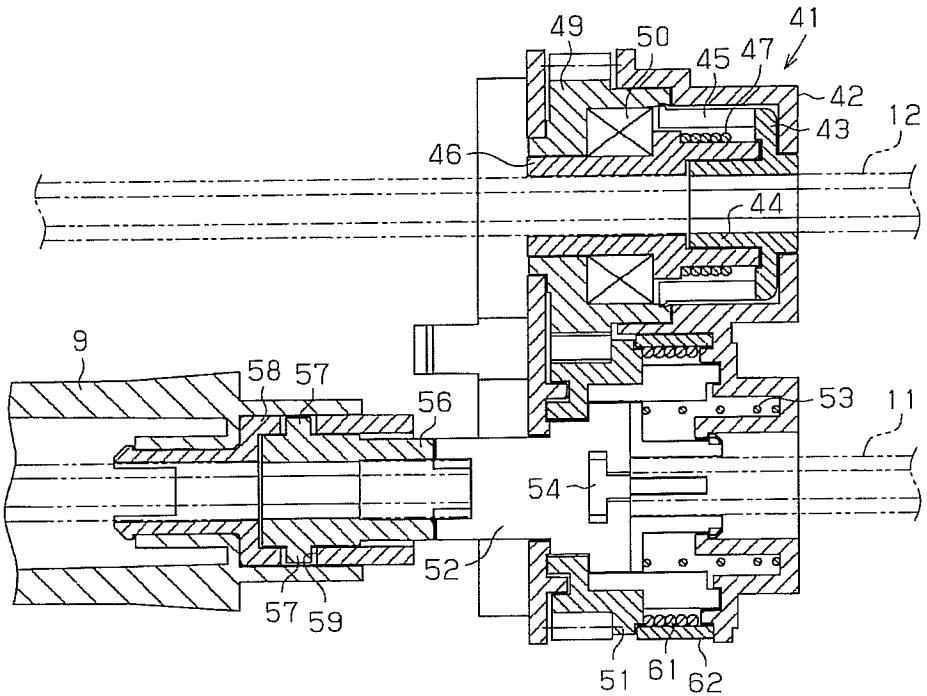
FIG. 11 is a sectional view illustrating the intermediate clutch.
Figure 12:
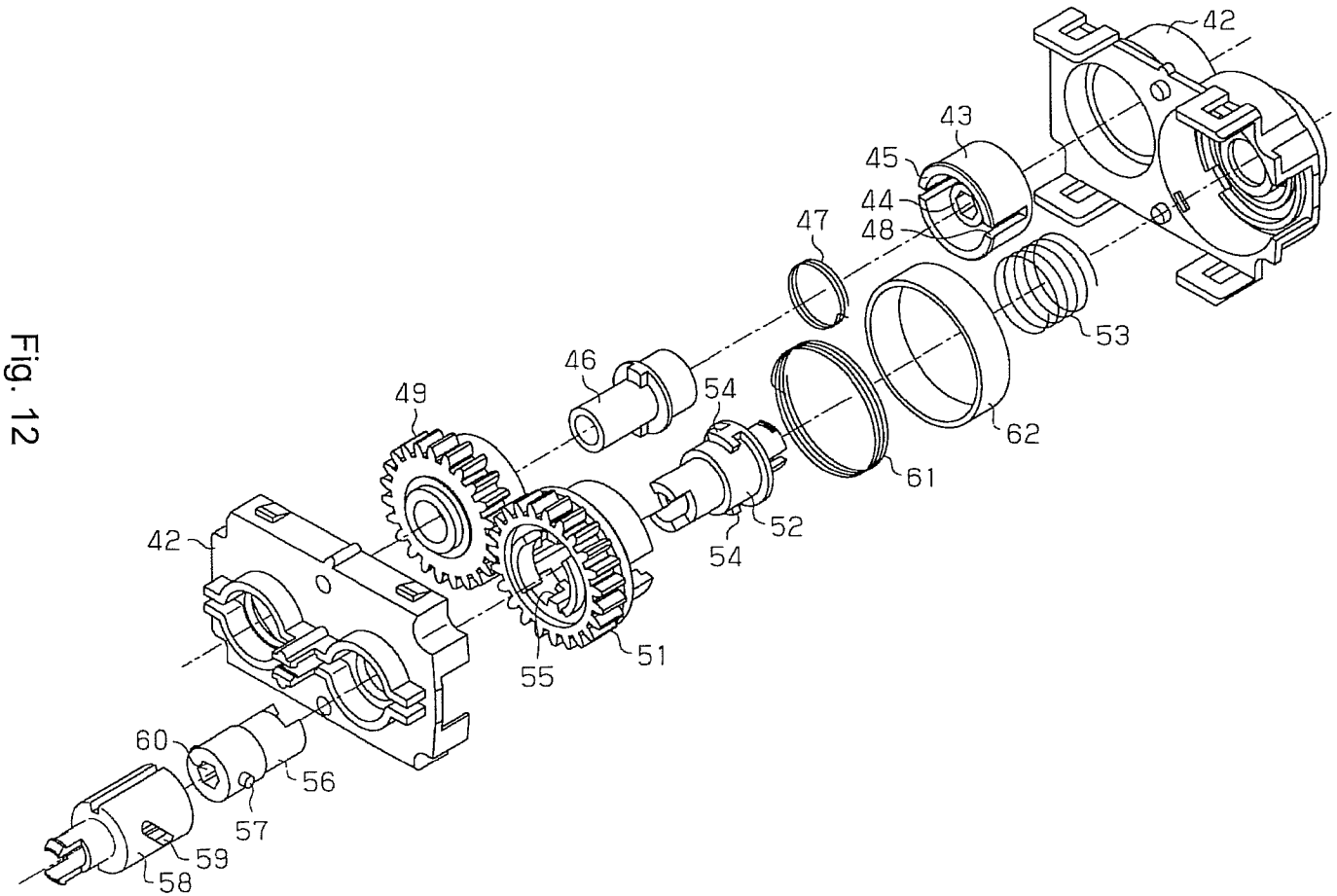
FIG. 12 is an exploded perspective view illustrating the intermediate clutch.

As shown in FIGS. 8 and 9, an intermediate clutch 41 is disposed on a side of one of the supporting members 8. The intermediate clutch 41 is configured, as shown in FIGS. 10 and 12, such that a driving drum 43 is supported so as to be rotatable at a rear position in a case 42, and the second driving shaft 12 is inserted through a hexagonal hole, which is formed in a central portion of the driving drum 43, such that their relative rotation is not possible. Therefore, the driving drum 43 rotates integrally with the second driving shaft 12.

At a front end of the driving drum 43 are formed an inner cylinder 44 and an outer cylinder 45, and a base end of a transmission shaft 46 is fitted so as to be rotatable with an outer peripheral surface of the inner cylinder 44. A slip spring 47 of a coil shape is fitted with an outer peripheral surface of the base end of the transmission shaft 46, and an end of the slip spring 47 engages with a locking groove 48 of the driving drum 43. Further, the driving drum 43 and the transmission shaft 46 usually rotate integrally due to friction between the slip spring 47 and the transmission shaft 46.

On a front end side of the transmission shaft 46, a driving gear 49 is supported in the case 42 so as to be rotatable, and a one-way clutch 50 is disposed between the driving gear 49 and the transmission shaft 46. When the second driving shaft 12 and the transmission shaft 46 are rotated in the direction for raising the bottom rail 5, the one-way clutch 50 is set in a locked state and transmits a rotation torque in a same direction to the driving gear 49. Further, when the second driving shaft 12 and the transmission shaft 46 are rotated in the direction for lowering the bottom rail 5, the one-way clutch 50 is set in a free state and does not transmit a rotation torque to the driving gear 49.

When a torque is applied to the slip spring 47 for rotating the second driving shaft 12 in the direction for raising the bottom rail 5 in a state where rotation of the driving gear 49 is hindered, the slip spring 47 causes the driving drum 43 to run idle with regard to the transmission shaft 46 and functions to prevent the one-way clutch 50 from being damaged.

A driven gear 51 configured to mesh with the driving gear 49 is supported so as to be rotatable at a front portion in the case 42, and a gear shaft (cam mechanism) 52 is inserted through a central portion of the driven gear 51 such that their relative rotation is possible. Further, a switchover spring 53 composed of a coil spring is disposed between the gear shaft 52 and the case 42, and the gear shaft 52 is always pushed in the direction of arrow E shown in FIG. 10 by a bias force of the switchover spring 53 with the case 42 as a fulcrum.

An engagement protrusion (engagement portion) 54 of a T-shape is formed on an outer peripheral surface of the gear shaft 52, and an engagement depression (engagement portion) 55 is formed on an inner peripheral surface of the driven gear 51, which is configured to engage with the engagement protrusion 54 when the gear shaft 52 moves in the direction of arrow E while rotating. When the engagement protrusion 54 is engaged with the engagement depression 55, the gear shaft 52 rotates integrally with the driven gear 51.

A base end of a cam shaft (cam mechanism) 56 is fitted with a front end of the gear shaft 52, and the cam shaft 56 rotates integrally with the gear shaft 52. On an outer peripheral surface of the cam shaft 56 are formed protrusions 57 that protrude line-symmetrically in radial directions.

A front end of the cam shaft 56 is fitted with a base end of a cam tube 58. A guide hole (slide apparatus) 59 for guiding a protrusion 57 of the cam shaft 56 is formed in the cam tube 58 so as to extend in an oblique direction, and the cam shaft 56 can move in the axial direction of the first driving shaft 11 while rotating relative to the cam tube 58.

The front end of the cam tube 58 is fitted with the first winding shaft 9, and the cam tube 58 and the first winding shaft 9 rotates integrally. Further, a hexagonal hole 60 is formed in the central portion of the cam shaft 56, and the first driving shaft 11 is inserted through the hexagonal hole 60 such that their relative rotation is not possible. Note that the first driving shaft 11 is inserted through central portions of the gear shaft 52 and cam tube 58 such that their relative rotation is possible.

Around a base end of the driven gear 51 is disposed a brake spring 61 which is fitted with an inner peripheral surface of a slide cylinder 62 made of a metal and secured to the case 42 such that rotation is not possible. The brake spring 61 is composed of a torsion coil spring, with one end engaged with the driven gear 51, and when the driven gear 51 is rotated in the direction for lowering the middle rail 3, the brake spring 61 has its diameter enlarged so that friction thereof with the slide cylinder 62 is increased, whereby inhibiting the driven gear 51 from rotating in a same direction (break apparatus).

Further, when the driven gear 51 is rotated in the direction for raising the middle rail 3, the friction of the brake spring 61 with the slide cylinder 62 is reduced so that the brake spring 61 allows the driven gear 51 to rotate in the same direction.

Figure 13:
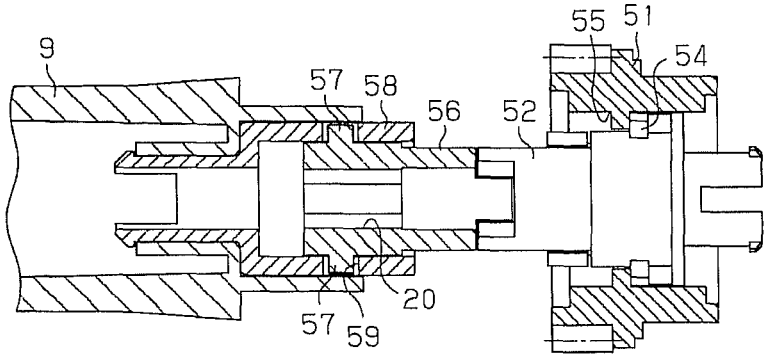
FIGS. 13(*a*) and (*b*) are sectional views illustrating operations of the intermediate clutch.
Figure 13:
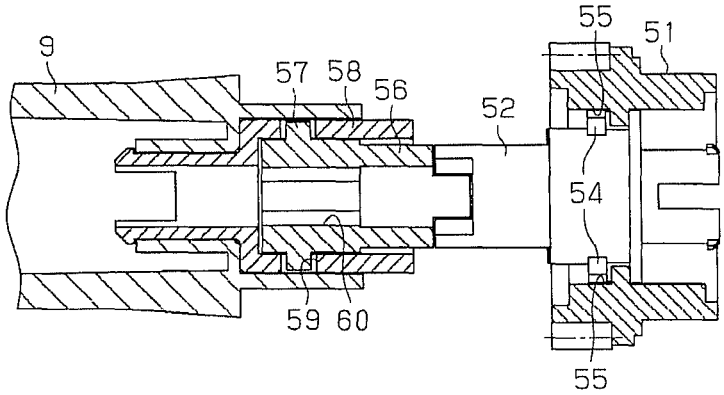

With intermediate clutch 41 configured as described above, in a state where a load of the middle rail 3 is applied to the first winding shaft 9, as shown in FIG. 10, the cam shaft 56 has been pushed and moved in the direction of arrow F due to an interaction of the cam shaft 56 and the cam tube 58. In this state, as shown in FIG. 13(*a*), the engagement between the engagement protrusion 54 of the gear shaft 52 and the engagement depression 55 of the driven gear 51 is canceled, so that the driven gear 51 and the gear shaft 52 rotate independently from each other.

In this state, when the second driving shaft 12 is rotated in the direction for raising the bottom rail 5, the driving gear 49 and the driven gear 51 are rotated, but the rotation of the driven gear 51 is not transmitted to the gear shaft 52.

Further, when the first driving shaft 11 is rotated, the gear shaft 52 is rotated via the cam shaft 56, but the rotation of the gear shaft 52 is not transmitted to the driven gear 51.

Meanwhile, when the load of the middle rail 3 stops applying to the first winding shaft 9 in a state where the second driving shaft 12 is rotated in the direction for raising the bottom rail 5, the gear shaft 52 moves in the direction of arrow E shown in FIG. 10 due to the bias force of the switchover spring 53 and the interaction of the cam shaft 56 and cam tube 58 (cam mechanism).

Accordingly, as shown in FIG. 13(*b*), the engagement protrusion 54 of the gear shaft 52 engages with the engagement depression 55 of the driven gear 51, so that a state is attained where the driven gear 51 and the gear shaft 52 rotate integrally with each other, so that the first driving shaft 11 and the first winding shaft 9 are rotated in the direction for raising the middle rail 3 based on the rotation of the driving gear 49. As a result, the middle rail 3 and the bottom rail 5 are raised simultaneously.

Next, an operation of the pleated screen equipped with the intermediate clutch 41 as described above will be described. The operations when the middle rail 3 is raised and lowered independently and when the bottom rail 5 is raised and lowered independently are the same as those of the first embodiment, and thus, the intermediate clutch 41 has no effect at all on the rotations of the first and second driving shafts 11, 12.

When the middle rail 3 is pushed up by the bottom rail 5, and thus, the bottom rail 5 and the middle rail 3 are raised together, the load of the middle rail 3 stops applying to the first winding shaft 9. Then, the gear shaft 52 moves in the direction of arrow E in FIG. 10 and is engaged with the driven gear 51, and is rotated integrally with the driven gear 51.

As a result, the first winding gear 9 is rotated in a winding-up direction of the first elevation cord 6, and the first elevation cord 6 is wound around the first winding shaft 9. Further, when the bottom rail 5 is raised to a desired level and thereafter the ball chain 16 is released from the user's hand, self-weight falling of the bottom rail 5 is hindered by the operation of the stopper apparatus 24, and the middle rail 3 is held on the bottom rail 5.

In a case lowering the bottom rail 5 in a state where the bottom rail 5 and the middle rail 3 have been raised together, when the ball chain 16 is slightly pulled in the direction of arrow A shown in FIG. 2 and subsequently released from the user's hand, the operation of preventing self-weight falling of the stopper apparatus 24 is canceled so that the bottom rail 5 self-weight falls.

At this time the rotation of the second driving shaft 12 is not transmitted to the driving gear 49 due to the operation of the one-way clutch 50.

When the bottom rail 5 is allowed to self-weight fall, though it is preferable to maintain the middle rail 3 at a raised level, the operation of preventing self-weight falling of the stopper apparatus 24 is not effective so that it is probable that the clutch ball 30 is in either of the lowering grooves 32*a*, 32*b*.

However, since the rotation of the driven gear 51 in the direction for lowering the middle rail 3 is always hindered by the brake spring 61, the middle rail 3 does not self-weight fall (self-weight falling restriction apparatus). When the ball chain 16 is operated in the direction of arrow B shown in FIG. 2 to rotate the first driving shaft 11, the engagement between the gear shaft 52 and the driven gear 51 is canceled so that the state is attained again where the middle rail 3 can be raised and lowered independently.

In a case where the bottom rail 5 and the middle rail 3 are raised together, then the bottom rail 5 is allowed to self-weight fall, and subsequently an operation of raising the bottom rail 5 is performed, the gear shaft 52 and the driven gear 51 may be still in a state of being engaged with each other so that the middle rail 3 may also be raised. When the middle rail 3 is raised to its upper limit, the first driving shaft 11 cannot be rotated any further in the same direction, so that the rotation of the driving gear 49 is hindered. In this state, when the second driving shaft 12 is forced to rotate further in the same direction in order to raise the bottom rail 5, the slip spring 47 slips and the driving drum 43 runs idle with respect to the transmission shaft 46 (transmission torque restriction apparatus). As a result of this, the one-way clutch 50 is prevented from being damaged by excessive torque.

That is, the intermediate clutch 41 comprises a driving drum 43 configured to rotate integrally with a second driving shaft 12 capable of winding a second elevation cord 7 by way of a second winding shaft 10, the second elevation cord 7 suspending a bottom rail 5; a driving gear 49 configured to rotate integrally with the driving drum 43 in accordance with a rotation of the second driving shaft 12 in a raising direction; a cam shaft 56 configured to rotate integrally with a first driving shaft 11 capable of winding a first elevation cord 6 by way of a first winding shaft 9, the first elevation cord 6 suspending a middle rail 3; a gear shaft 52 supported so as to be capable of rotating together with the cam shaft 56 and moving in an axial direction of the first driving shaft 11; a driven gear 51 disposed on an axial line of the first driving shaft 11 and configured to mash with the driving gear 49; a cam tube 58 configured to rotate integrally with the first winding shaft 9 and not to be capable of moving in an axial direction of the first winding shaft 9; bias means 53 configured to bias the gear shaft 52 toward a rotation transmitting position where a rotation of the driven gear 51 is transmitted to the gear shaft 52; and an engagement portion provided on the gear shaft 52 and the driven gear 51 and configured to transmit the rotation of the driven gear 51 to the gear shaft 52 when the gear shaft 52 is moved to the rotation transmitting position.

In the intermediate clutch 41, the cam shaft 56 is provided with a protrusion 57, the cam tube 58 is provided with a guide hole 59 so as to engage with the protrusion 57, the gear shaft 52 is located, when a rotation torque due to a tension of the first elevation cord 6 is applied, such that the rotation of the driven gear 51 is not transmitted to the gear shaft 52, and the guide hole 59 is so configured as to move the gear shaft 52 to the rotation transmitting position along the first driving shaft 11 when the rotation torque due to the tension of the first elevation cord 6 is not applied to the first winding shaft 9.

According to the pleated screen equipped with the intermediate clutch 41 as described above, the following effects can be obtained in addition to the effects obtained by the first embodiment.

(1) When the bottom rail 5 is raised and then the bottom rail 5 and the middle rail 3 are raised together, the first elevation cord 6 can be wound around the winding shaft 9. Therefore, it is possible to prevent the first elevation cord 6 from loosening within or outside the head box 1, so that it is possible to prevent the first elevation cord 6 from being caught in the head box 1, from extruding out of the upper screen 2 as folded and from the like in advance.

(2) When the bottom rail 5 is allowed to self-weight fall after the bottom rail 5 and the middle rail 3 are raised together, it is possible to prevent the middle rail 3 from self-weight falling simultaneously.

(3) When the bottom rail 5 and the middle rail 3 are raised together, the bottom rail 5 is allowed to self-weight fall, and subsequently an operation of raising the bottom rail 5 is performed, even if the bottom rail 5 is forced to be raised in a state where the raising of the middle rail 3 is hindered, it is possible to prevent the one-way clutch 50 from being damaged.

(4) When the middle rail 3 is pushed up by the bottom rail 5 and the load of the middle rail 3 stops applying to the first driving shaft 11, the operation of winding up the first elevation cord 6 by the first winding shaft 9 can be started immediately. Therefore, even if elongation of the first and second elevation cords 6, 7 occurs, it is possible to prevent in advance the first elevation cord 6 from loosening when the middle rail 3 and the bottom rail 5 are raised together.

Third Embodiment

Figure 14:
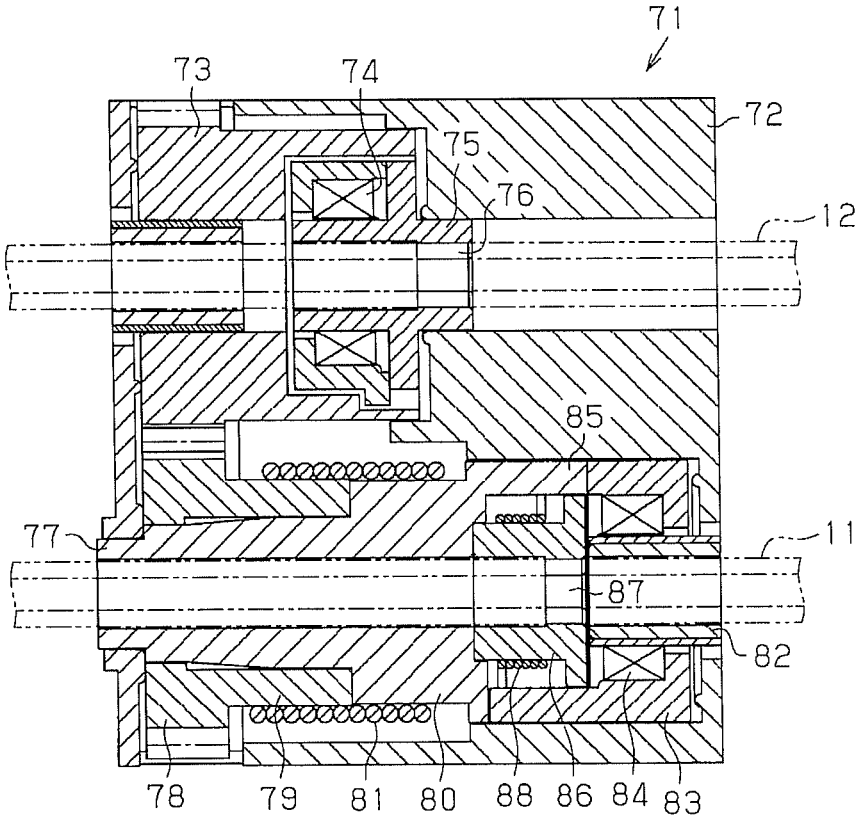
FIG. 14 is a sectional view illustrating an intermediate clutch of a third embodiment.
Figure 15:
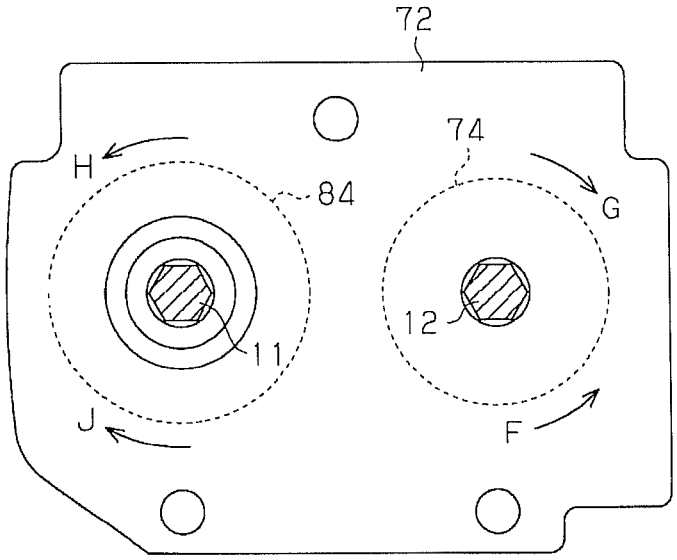
FIG. 15 is a side view illustrating the intermediate clutch of the third embodiment.

FIGS. 14 and 15 show a third embodiment. This embodiment comprises an intermediate clutch 71 which is different from the intermediate clutch 41 of the second embodiment and the stopper apparatus 24 whose configuration is partly modified, but the other configurations are the same as those of the first and second embodiments. The components same as those of the first and second embodiments are denoted by the same reference symbols, and detailed descriptions thereof are omitted.

In the intermediate clutch 71 shown in FIG. 14, a driving gear 73 is supported in a case 72 so as to be rotatable, and a one-way clutch 74 is housed on one side of the driving gear 73. A one-way clutch shaft 75 is inserted through a central portion of the one-way clutch 74, and a hexagonal hole 76 is formed in a central portion of the one-way clutch shaft 75. Further, the second driving shaft 12 is inserted through the hexagonal hole 76.

The one-way clutch 74 does not transmit a rotation of the second driving shaft 12 in the direction of arrow F shown in FIG. 15, i.e., the direction for lowering the bottom rail 5, to the driving gear 73, but do transmit a rotation of the second driving shaft 12 in the direction of arrow G shown in FIG. 15, i.e., the direction for raising the bottom rail 5, to the driving gear 73. On a side of the driving gear 73, a first spring clutch shaft 77 is supported in the case 72 so as to be rotatable, and a driven gear 78 which meshes with the driving gear 73 is supported so as to be rotatable by the first spring clutch shaft 77.

An axial portion 79 on a base end side of the driven gear 78 and a base end 80 of the first spring clutch shaft 77 are formed to have a roughly same diameter, and a clutch spring 81 is fitted on the outer peripheral surfaces of the axial portion 79 and the base end 80. The first spring clutch shaft 77 is made of a metal, an outer diameter of the base end 80 is formed so as to be slightly smaller than an outer diameter of the axial portion 79 of the driven gear 78 made of a synthetic resin, and friction between the clutch spring 81 and the base end 80 of the first spring clutch shaft 77 is so set as to be smaller than friction between the clutch spring 81 and the axial portion 79 of the driven gear 78.

Further, the intermediate clutch 71 is configured such that in a state where the load of the middle rail 3 is applied to first spring clutch shaft 77, even if the driven gear 78 is rotated, the clutch spring 81 runs idle with regard to the first spring clutch shaft 77 so that a rotation of the driven gear 78 is not transmitted to the first spring clutch shaft 77.

Meanwhile, the intermediate clutch 71 is configured such that in a state where the load of the middle rail 3 is not applied to the first spring clutch shaft 77, the rotation of the driven gear 78 is transmitted to the first spring clutch shaft 77 by way of the clutch spring 81 due to the friction between the base end 80 of the first spring clutch shaft 77 and the clutch spring 81.

On the base end side of the first spring clutch shaft 77, a one-way clutch 84 is disposed between a support tube 82 disposed in the case 72 and a housing 83 located around the support tube 82. The one-way clutch 84 operates, with the support tube 82 as a fulcrum, to allow a rotation of the housing 83 in the direction of arrow H shown in FIG. 15, i.e., the direction for raising the middle rail 3, but prevents a rotation in the direction of arrow J, i.e., the direction for lowering the middle rail 3.

A second spring clutch shaft 86 is supported so as to be rotatable between the housing 83 and an engagement piece 85 extending at the base end of the first spring clutch shaft 77, and a hexagonal hole 87 is formed in a central portion of the second spring clutch shaft 86. The first driving shaft 11 is inserted through the hexagonal hole 87 such that their relative rotation is not possible. Further, the first driving shaft 11 is inserted through the first spring clutch shaft 77 and the support tube 82 such that their relative rotation is possible.

A clutch spring 88 is fitted on an outer peripheral surface of the second spring clutch shaft 86, and both ends of the clutch spring 88 are configured to be capable of engaging with the engagement piece 85 of the first spring clutch shaft 77 and the housing. Further, a predetermined angle of idle run is ensured from the first spring clutch shaft 77 starts rotating till the engagement piece 85 abuts on an end of the clutch spring 88 (idle run means).

Furthermore, friction between the clutch spring 88 and the second spring clutch shaft 86 is set so as to be smaller than friction between the clutch spring 81 and the first spring clutch shaft 77.

This embodiment is different from the first and second embodiments in a configuration of a guide groove of a second drum through which the second driving shaft 12 is inserted, in the drum housed in the stopper apparatus 24.

Figure 16:
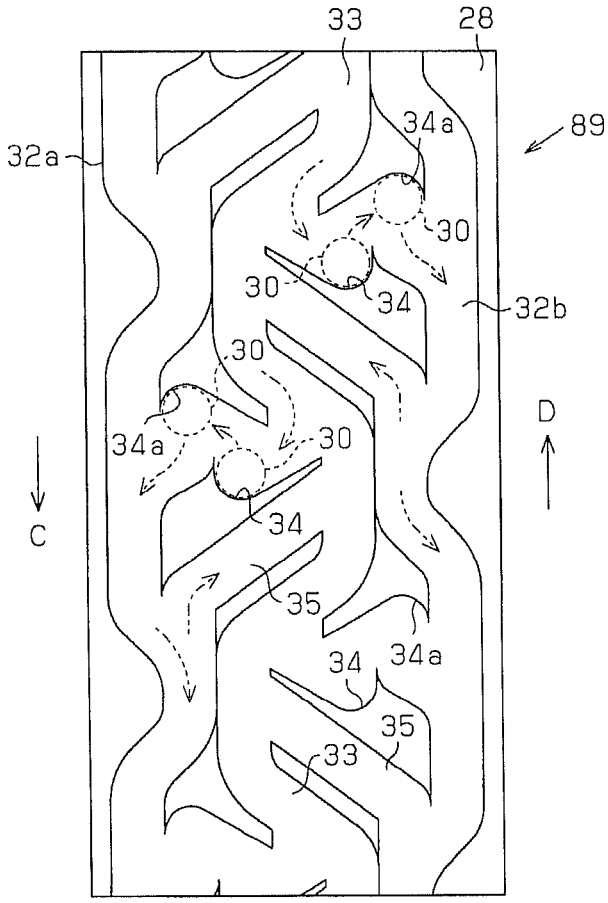
FIG. 16 is a development view illustrating a guide groove of a stopper apparatus of the third embodiment.

A guide groove 89 of a second drum 28 is shown in FIG. 16. The guide groove 89 is provided with a locking portion (restriction means) 34*a* which restricts a rotation angle of the second driving shaft 12 when the second driving shaft 12 is rotated in the direction for raising the bottom rail 5 (direction of arrow D in FIG. 16) in order to cancel the self-weight falling of the bottom rail 5 from the state where self-weight falling of the bottom rail 5 is hindered by locking the clutch ball 30 by the locking portion 34. Other configurations are the same as those of the guide groove 31 of the previous embodiment.

Thereafter, in a state where the clutch ball 30 is located at the locking portion 34 and the self-weight falling of the bottom rail 5 is prevented, the ball chain 16 is operated to rotate the second driving shaft 12 in the direction for raising the bottom rail 5, whereby moving the clutch ball 30 to the locking portion 34*a*, and, in this state, the ball chain 16 is released from the user's hand.

Then, the clutch ball 30 moves in either of the lowering groove 32*a*, 32*b*, and the bottom rail 5 self-weight falls.

The rotation angle of the second driving shaft 12 required for the second drum 28 to move the clutch ball 30 from the locking portion 34 to the locking portion 34*a* is determined such that it is smaller than a sum of an idle run angle of the first spring clutch shaft 77 before abutting on an end of the clutch spring 88 and an angle required for the first drum 27 to guide the clutch ball 30 from the locking portion 34 to either of the lowering grooves 32*a*, 32*b*.

Next, an operation of the pleated screen equipped with the intermediate clutch 71 configured as described above will be described.

When operations of raising or lowering the middle rail 3 and operations of raising or lowering the bottom rail 5 are performed independently from each other, the load of the middle rail 3 is applied to the first spring clutch shaft 77 by way of the first driving shaft 11, the second spring clutch shaft 86 and the clutch spring 88.

When the ball chain 16 is operated, in this state, to rotate the first driving shaft 11 in the direction for raising the middle rail 3, in the intermediate clutch 71, the rotation of the first driving shaft 11 is transmitted from the second spring clutch shaft 86 to the driven gear 78 by way of the clutch spring 88, the first spring clutch shaft 77 and the clutch spring 81, so that the driving gear 73 is rotated. However, the one-way clutch 74 runs idle so that the rotation of the driving gear 73 is not transmitted to the second driving shaft 12. As a result of this, the middle rail 3 is raised, and when the ball chain 16 is released from the user's hand, the middle rail 3 is maintained at a desired level by the operation of the stopper apparatus 24.

When the ball chain 16 is operated, in this state, to cancel the operation of the stopper apparatus 24 on the first driving shaft 11, the load of the middle rail 3 is applied to the first driving shaft 11. Since the one-way clutch 84 is hindering the rotation of the housing 83 in the direction for lowering the middle rail 3, a slip occurs between the second spring clutch shaft 86 and the clutch spring 88 due to the load of the middle rail 3, so that the first driving shaft 11 and the second spring clutch shaft 86 rotate. As a result of this, the middle rail 3 self-weight falls.

When the ball chain 16 is operated to rotate the second driving shaft 12 in the direction for raising the bottom rail 5, in the intermediate clutch 71, the driving gear 73 is rotated by way of the one-way clutch 74, and the driven gear 78 is rotated.

Since the load of the middle rail 3 is being applied to the first spring clutch shaft 77, the rotation of the driven gear 78 is not transmitted to the first spring clutch shaft 77. Therefore, the middle rail 3 is not raised.

In a state where the bottom rail 5 is maintained at a desired level by the operation of the stopper apparatus 24, when the operation of preventing self-weight falling of the stopper apparatus 24 on the second driving shaft 12 is canceled by the operation of the ball chain 16, the second driving shaft 12 is rotated due to the load of the bottom rail 5 so that the bottom rail 5 is lowered.

At this time, in the intermediate clutch 71, the second driving shaft 12 can be rotated freely by the one-way clutch 74, but the driving gear 73 is not rotated.

When the middle rail 3 is pushed up by the bottom rail 5 and the bottom rail 5 and the middle rail 3 are raised together from the state where self-weight falling of the middle rail 3 is hindered by the stopper apparatus 24, the rotation of the second driving shaft 12 is transmitted to the driven gear 78 by way of the driving gear 73.

Based on the rotation of the driven gear 78, the clutch spring 81 is rotated integrally with the driven gear 78. Since the load of the middle rail 3 is not being applied to the first spring clutch shaft 77, the driven gear 78 and the first spring clutch shaft 77 are rotated integrally with each other by way of the clutch spring 81, and the second spring clutch shaft 86 is rotated integrally with the first spring clutch shaft 77.

As a result of this, the first driving shaft 11 is rotated in the direction for raising the middle rail 3, and the first elevation cord 6 is wound around the first winding shaft 9.

When the bottom rail 5 and the middle rail 3 are raised together to a desired level and then the ball chain 16 is released from the user's hand, self-weight falling of the bottom rail 5 is hindered by the stopper apparatus 24, and the bottom rail 5 and the middle rail 3 are maintained at the desired level.

When the ball chain 16 is operated, in this state, to rotate the second driving shaft 12 in the direction for raising the bottom rail 5, so that the clutch ball 30 is moved as shown in FIG. 16, on the second drum 28, from the locking portion 34 to the locking portion 34*a*, and then the ball chain 16 is released from the user's hand, the bottom rail 5 self-weight falls.

At this time, on the first drum 27, the clutch ball 30 does not reach either of the lowering grooves 32*a*, 32*b*, and the clutch ball 30 goes back to the locking portion 34 by releasing the ball chain 16 from the user's hand, so that self-weight falling of the bottom rail 5 and the middle rail 3 together is hindered.

According to the pleated screen equipped with the intermediate clutch 71 and the stopper apparatus 24 as described above, the following effects are obtained in addition to those obtained by the first embodiment.

(1) When the bottom rail 5 is raised and then the bottom rail 5 and the middle rail 3 are raised together, the first elevation cord 6 can be wound around the winding shaft 9. Therefore, it is possible to prevent the first elevation cord 6 from loosening within or outside the head box 1, so that it is possible to prevent the first elevation cord 6 from being caught in the head box 1, from extruding out of the upper screen 2 as folded and from the like in advance.

(2) When the bottom rail 5 is allowed to self-weight fall after the bottom rail 5 and the middle rail 3 are raised together, it is possible to prevent the middle rail 3 from self-weight falling simultaneously.

(3) When the bottom rail 5 and the middle rail 3 are raised simultaneously, even if the bottom rail 5 is forced to be raised in a state where the raising of the middle rail 3 is hindered, since the driven gear 78 runs idle with respect to the first spring clutch shaft 77, it is possible to prevent the intermediate clutch 71 from being damaged.

Fourth Embodiment

Figure 17:
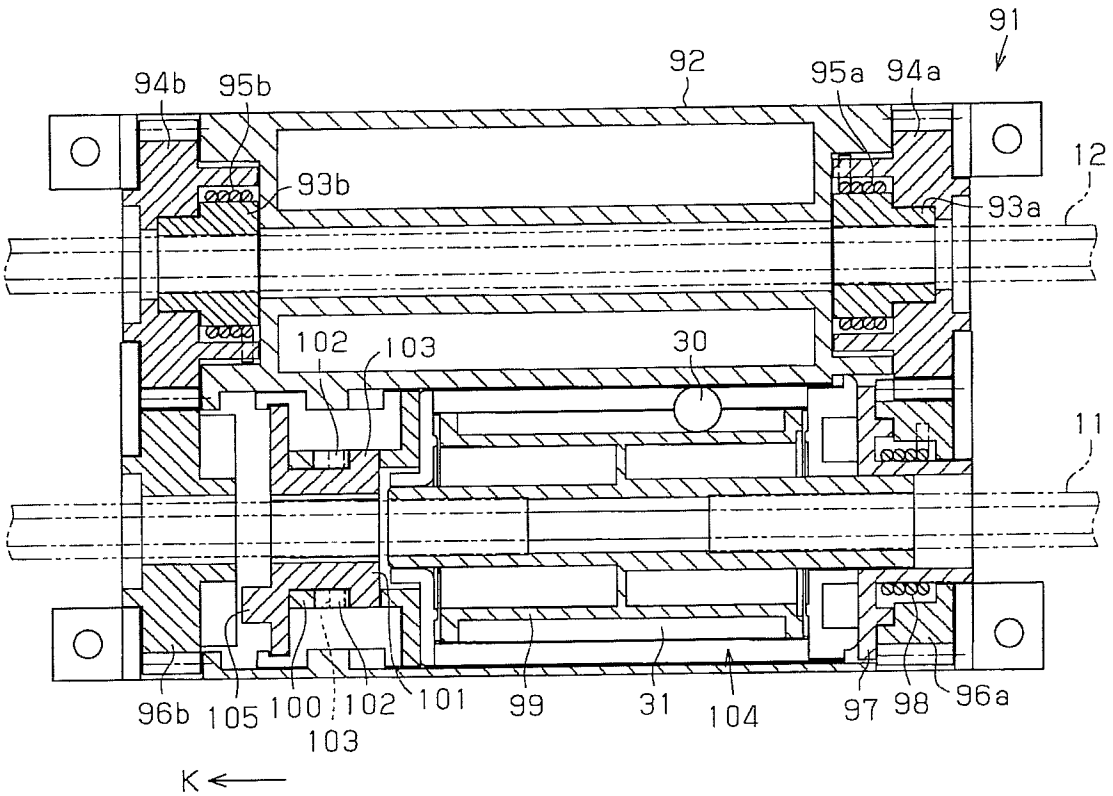
FIG. 17 is a sectional view illustrating an intermediate clutch of a fourth embodiment.

FIG. 17 shows a fourth embodiment. This embodiment comprises an intermediate clutch 91 which is different from the intermediate clutch 41 of the second embodiment and the stopper apparatus 24 whose configuration is partly modified, but the other configurations are the same as those of the first and second embodiments. The components same as those of the first and second embodiments are denoted by the same reference symbols, and detailed descriptions thereof are omitted.

In the intermediate clutch 91 shown in FIG. 17, clutch drums 93*a*, 93*b* are supported so as to be rotatable on both sides of a case 92, and driving gears 94*a*, 94*b* are supported so as to be rotatable at front ends of the clutch drums 93*a*, 93*b*. On outer peripheral surfaces of the clutch drums 93*a*, 93*b* are fitted clutch springs 95*a*, 95*b* each composed of a torsion coil spring, and ends of the clutch springs 95*a*, 95*b* are engaged with the driving gears 94*a*, 94*b*.

The second driving shaft 12 is inserted through the clutch drums 93*a*, 93*b* such that their relative rotation is not possible. Therefore, the clutch drums 93*a*, 93*b* are rotated integrally with the second driving shaft 12.

Further, when the driving shaft 12 is rotated in the direction for raising the bottom rail 5, the clutch springs 95*a*, 95*b* transmit the rotation to the driving gears 94*a*, 94*b*, but when the driving shaft 12 is rotated in the direction for lowering the bottom rail 5, the clutch gears 95*a*, 95*b* turn idle with respect to the clutch drums 93*a*, 93*b*.

A driven gear 96*a* which meshes with the driving gear 94*a* is supported so as to be rotatable at an end of a stopper case 97 which composes a stopper apparatus 104 for the middle rail 3, and on an end of the stopper case 97 is fitted a clutch spring 98 whose one end is engaged with the driven gear 96*a*. The stopper case 97 is supported so as to be rotatable in a range of 90 degrees with respect to the case 92 of the intermediate clutch 91.

In the stopper case 97 is housed a drum 99 on which the guide groove 31 is formed and which is similar to the first drum 27 of the stopper apparatus 24 of the first embodiment, and the clutch ball 30, which moves along the guide groove 31, is disposed between the drum 99 and the stopper case 97. The first driving shaft 11 is inserted through the drum 99, so that the drum 99 is rotated integrally with the first driving shaft 11.

A cam shaft 101 is supported so as to be rotatable in a cylinder portion 100 formed at another end of the stopper case 97, and the first driving shaft 11 is inserted through a hexagonal hole formed in a central portion of the cam shaft 101 so that the cam shaft 101 is rotated integrally with the first driving shaft 11.

A guide hole 102 in an oblique direction is formed in the cylinder portion 100 similarly to the guide hole 59 formed in the cam tube 58 of the second embodiment. A protrusion 103 protruding inside the guide hole 102 is formed at a base end of the cam shaft 101. When the stopper case 97 is rotated, the protrusion 103 is guided along the guide hole 102, so that the cam shaft 101 moves in the direction of arrow K while rotating.

The driven gear 96*b* meshing with the driving gear 94*b* is supported by the case 92 so as to be rotatable. When the cam shaft 101 is moved in the direction of arrow K, a locking piece 105 of the cam shaft 101 engages with the driven gear 96*b*, so that the driven gear 96*b* and the cam shaft 101 rotate integrally with each other.

The second driving shaft 12 is inserted, outside the intermediate clutch 91, through a drum which is equipped with a function of preventing self-weight falling similar to the second drum 28 of the stopper apparatus 24 of the first embodiment. Meanwhile, since the first driving shaft 11 is equipped with a function of preventing self-weight falling by means of the drum 99, it does not require another stopper apparatus.

Next, an operation of the intermediate clutch 91 configured as described above will be described. In operating the ball chain 16 to perform the operation of raising the bottom rail 5, when the second driving shaft 12 is rotated in the direction for raising the bottom rail 5, the driving gears 94*a*, 94*b* are rotated by way of the clutch drums 93*a*, 93*b*.

The driven gear 96*a* is rotated based on the rotation of the driving gear 94*a*, however, since the load of the middle rail 3 is being applied to the stopper case 97 from the first driving shaft 11 by way of the drum 99 and the clutch ball 30, the clutch spring 98 runs idle with respect to the stopper case 97 so that the stopper case 97 is not rotated.

The rotation of the driving gear 94*b* is transmitted to the driven gear 96*b*, however, the driven gear 96*b* is not engaged with the cam shaft 101. Therefore, the intermediate clutch 91 does not function at all during the operation of raising the bottom rail 5.

In the operation of lowering the bottom rail 5, the operation the stopper apparatus for preventing self-weight falling is canceled by the operation of the ball chain 16, and the second driving shaft 12 is rotated in the direction for lowering the bottom rail 5. At this time, the rotation of the second driving shaft 12 is not transmitted to the driving gears 94*a*, 94*b*, and the intermediate clutch 91 does not function at all.

In the operation of raising the middle rail 3, the first driving shaft 11 is rotated in the direction for raising the middle rail 3. Then, the drum 99 is rotated so that the clutch ball 30 is moved along the guide groove 31 of the drum 99. Thereafter, when the ball chain 16 is released from the user's hand, the middle rail 3 is maintained at a desired level by the stopper apparatus 104.

When the operation of the stopper apparatus 104 for preventing self-weight falling is canceled by rotating the first driving shaft 11 through the operation of the ball chain 16, the first driving shaft 11 is rotated in the direction for lowering the middle rail 3 so that the middle rail 3 self-weight falls.

When the middle rail 3 is pushed up by the bottom rail 5 and thus the bottom rail 5 and the middle rail 3 are raised together, the load of the middle rail 3 stops applying to the stopper case 97. When, in this state, the second driving shaft 12 is rotated in the direction for raising the bottom rail 5, the driving gears 94*a*, 94*b* are rotated and the driven gears 96*a*, 96*b*, which mesh with the driving gear 94*b*, are rotated.

When the driven gear 96*a* is rotated, the stopper case 97 is rotated by 90 degrees by way of the clutch spring 98. Then, the cam shaft 101 moves in the direction of arrow K so that a state is attained where the cam shaft 101 rotates integrally with the driven gear 96*b*. As a result of this, the rotation of the second driving shaft 12 is transmitted to the first driving shaft 11, so that the first elevation cord 6 is wound around the first winding shaft 9 in accordance with elevation of the middle rail 3.

According to the pleated screen equipped with the intermediate clutch 91 and the stopper apparatus 104 as described above, the following effects can be obtained.

(1) When the bottom rail 5 is raised and then the bottom rail 5 and the middle rail 3 are raised together, the first elevation cord 6 can be wound around the first winding shaft 9. Therefore, it is possible to prevent the first elevation cord 6 from loosening within or outside the head box 1, so that it is possible to prevent the first elevation cord 6 from being caught in the head box 1, from extruding out of the upper screen 2 as folded and from the like in advance.

The embodiments may be implemented in the following manners. In addition to being used in an elevation apparatus provided in a pleated screen, a horizontal blind, or a roll-up curtain or the like for raising and lowering a screen, slats or a curtain or the like, the embodiments may be employed in an elevation apparatus provided in an apparatus which allows or blocks flow of air or controls insulation of heat, in a screen on which images are projected, and in a screen for protection from insects. The first and second driving shafts 11, 12 may be operated to rotate by means of operation cords which are independent from each other. The first and second driving shafts 11, 12 may be operated to rotate by a motor.

DESCRIPTION OF REFERENCE NUMERALS

1 . . . head box, 2 . . . shielding member (upper screen), 3 . . . middle rail, 4 . . . shielding member (lower screen), 5 . . . bottom rail, 6 . . . first elevation cord, 7 . . . second elevation cord, 11 . . . first driving shaft, 12 . . . second driving shaft, 13 . . . selective operation means (elevation apparatus, operation apparatus), 16 . . . operation cord (ball chain), 41, 71, 91 . . . elevation apparatus (intermediate clutch).

The invention claimed is:

1. A shielding apparatus comprising:

a middle rail suspended from a head box by way of a first elevation cord so as to be capable of being raised and lowered;

a bottom rail suspended from the head box by way of a second elevation cord so as to be capable of being raised and lowered;

a shielding member suspended at least between the middle rail and the bottom rail; and an elevation apparatus configured to wind up or wind off the second elevation cord within the head box so as to raise or lower the middle rail and the bottom rail, whereby the shielding member can be pulled out in the vertical direction or folded in, wherein the elevation apparatus comprises:

an operation cord of an endless type hanging down from the head box; and selective operation means configured to be capable of raising or lowering the middle rail through an operation of the operation cord in one direction, and capable of raising or lowering the bottom rail through an operation of the operation cord in another direction, and wherein the selective operation means can be set to move the bottom rail so that the bottom rail and shielding member then come in contact with and move up together with the middle rail.

2. The shielding apparatus of claim 1, wherein the elevation apparatus comprises an intermediate clutch that winds up the first elevation cord for suspending the middle rail around a first winding shaft in the head box when the bottom rail and the middle rail are raised together.

3. The shielding apparatus of claim 2, wherein the elevation apparatus comprises:

the first winding shaft configured to wind therearound the first elevation cord;

a second winding shaft configured to wind therearound the second elevation cord for suspending the bottom rail;

a first driving shaft configured to rotationally drive the first winding shaft; and a second driving shaft configured to rotationally drive the second winding shaft, wherein the intermediate clutch comprises a transmission apparatus configured to transmit a rotation of the second driving shaft to the first driving shaft when a load of the middle rail is not applied to the first winding shaft.

4. The shielding apparatus of claim 3, wherein the transmission apparatus comprises:

a driving gear configured to rotate integrally with the second driving shaft;

a driven gear configured to mesh with the driving gear; and a cam mechanism configured to couple the driven gear and the first driving shaft with each other when no load is applied to the first winding shaft.

5. The shielding apparatus of claim 4, wherein the cam mechanism comprises:

a gear shaft configured to rotate integrally with the first driving shaft and supported so as to be movable in an axial direction of the first driving shaft;

a slide apparatus configured to move the gear shaft along the first driving shaft to a rotation transmitting position when the load of the middle rail is not applied to the first driving shaft; and an engagement portion provided on the gear shaft and the driven gear and configured to transmit a rotation of the driven gear to the gear shaft when the gear shaft is moved to the rotation transmitting position.

6. The shielding apparatus of claim 5, wherein the slide apparatus comprises:

a guide hole provided in a cam tube configured to rotate integrally with the first winding shaft;

a cam shaft configured to rotate integrally with the gear shaft and provided with a protrusion configured to engage with the guide hole, the guide hole guiding the gear shaft to the rotation transmitting position when the load of the middle rail is not applied to the first driving shaft; and bias means configured to bias the gear shaft toward the rotation transmitting position.

7. The shielding apparatus of claim 4, wherein the intermediate clutch comprises a brake apparatus configured to hinder self-weight falling of the middle rail in a state where the driven gear and the first driving shaft are coupled with each other.

8. The shielding apparatus of claim 4, wherein the intermediate clutch comprises:

a one-way clutch configured to transmit only a rotation of the second driving shaft in a direction for raising the bottom rail to the driving gear; and a transmission torque restriction apparatus disposed between the one-way clutch and the second driving shift, and configured to restrict a rotation torque transmitted from the second driving shaft to the one-way clutch.

9. The shielding apparatus of claim 3, wherein the intermediate clutch comprises:

a driven gear to which the rotation of the second driving shaft in the direction for raising the bottom rail is transmitted;

a first clutch shaft to which a rotation of the driven gear is transmitted by way of a torque transmission apparatus; and a second clutch shaft configured to transmit a rotation of the first clutch shaft to the first driving shaft and to transmit the load of the middle rail applied to the first driving shaft to the first clutch shaft, wherein the torque transmission apparatus causes the driven gear to run idle with regard to the first clutch shaft when the load of the middle rail is applied to the first clutch shaft.

10. The shielding apparatus of claim 1, wherein the elevation apparatus comprises:

a stopper apparatus configured to shift to an operation of preventing self-weight falling of the middle rail and the bottom rail when the operation cord is released after an operation of raising the middle rail and the bottom rail; and a self-weight falling restriction apparatus configured to hinder simultaneous cancellation of the operation of preventing self-weight falling of the middle rail when the operation of preventing self-weight falling of the bottom rail by the stopper apparatus is canceled, after an operation of raising the middle rail and the bottom rail together.

11. The shielding apparatus of claim 10, wherein the stopper apparatus allows the operation of preventing self-weight falling to be canceled when the first driving shaft and the second driving shaft are rotated in a direction for raising the middle rail and the bottom rail, and the self-weight falling restriction apparatus comprises:

restriction means configured to restrict an rotation angle of the second driving shaft when the operation of preventing self-weight falling of the bottom rail is canceled; and idle run means configured to cause the first driving shaft to run idle after the second driving shaft is rotated.

* * * * *